US005107235A

United States Patent [19]

Torres-Isea

[11] Patent Number: 5,107,235

[45] Date of Patent: Apr. 21, 1992

[54] CURRENT DRIVEN ACTUATOR WITH COUPLED THERMAL AND MAGNETIC ACTUATING ELEMENTS

[75] Inventor: Torres-Isea, Cedar Rapids, Iowa

[73] Assignee: Square D Company, Palatine, Ill.

[21] Appl. No.: 645,538

[22] Filed: Jan. 24, 1991

[51] Int. Cl.[5] ..... H01H 71/18; H01H 75/12; H01H 61/06

[52] U.S. Cl. ..... 335/35; 337/140

[58] Field of Search ..... 337/140, 1, 2, 3; 335/36, 37, 217, 218, 219, 35

[56] References Cited

U.S. PATENT DOCUMENTS 4,275,370 6/1981 Sims ..... 337/140

FOREIGN PATENT DOCUMENTS 419390 11/1934 United Kingdom ..... 337/140

*Primary Examiner*—Harold Broome

*Attorney, Agent, or Firm*—Larry I. Golden; Jose W. Jimenez; Wayne H. Stoppelmoor

[57] ABSTRACT

An electric current responsive actuator has a thermally responsive force generator and an electromagnetically responsive force generator. The force generators are coupled together to produce a resultant force on a movable trip actuator. In the preferred specific embodiment of the invention, a shape-memory alloy element serves as the thermally responsive force generator.

6 Claims, 3 Drawing Sheets

CURRENT DRIVEN ACTUATOR WITH COUPLED THERMAL AND MAGNETIC ACTUATING ELEMENTS

BACKGROUND OF THE INVENTION

1. Field of the Invention

The present invention generally relates to electric current responsive actuators such as circuit breakers, contactors and other electrical distribution and control devices. More particularly it relates to an improved actuator in which electromagnetic and thermal actuating elements are coupled together to produce a resultant actuation force which enhances the thermal tripping characteristics of the actuator.

2. Description of the Prior Art

Circuit breakers and other electric current responsive distribution and control devices in the prior art employ separate thermal and magnetic tripping mechanisms. Typically, the thermal tripping mechanism responds to currents slightly in excess of nominal which persist for a relatively long interval and the magnetic tripping mechanism responds in a short interval to currents substantially in excess of nominal. At current levels below the level for magnetic actuation, the trip characteristic is a function of the product of the square of the current and time. At modest overcurrents, the overcurrent which passes through before tripping is determined by the type and size of the thermal elements used. As a practical matter this limits the thermal response which can be realized with prior art actuators.

U.S. Pat. No. 4,275,370 to Sims discloses an electrical overload circuit breaker which uses a solenoid as the current-responsive tripping mechanism. The solenoid coil is a helical spring made of a shape memory alloy. The shape-memory alloy spring mechanically acts upon the solenoid armature. Current passing through the dual function shape-memory alloy spring and solenoid coil urges the armature both mechanically and electromagnetically in tripping direction. While providing a compact unit, the Sims breaker is designed so that mechanical and electromagnetic forces act essentially independently to trip the breaker in response to an over-current condition. In the Sims device, with currents in a range of about 1.5 to 4 times nominal current, the electromagnet force is not sufficient to trip an over-center toggle and tripping of the toggle is effected by a prolonged over current of sufficient duration to result in a temperature rise in the shape memory effect spring through its transition temperature range. When a massive overload (e.g., 4 to 9 times nominal current) occurs, the high current through the helical spring generates a large magnetic force on the armature which trips the toggle. In the massive overload situation, any force generated by the shaped memory effect of the spring takes little part in the tripping action.

SUMMARY OF THE INVENTION

An object of this invention is the provision of a compact electric current responsive actuator; one that has a fast thermal response and enhanced, flexible thermal actuation characteristics.

Another object of the invention is the provision of an actuator in which two independently variable force generators, a thermal and an electromagnetic force generator, act in concert to provide a net actuation response with enhanced characteristics in the range of thermal operation. Briefly, this invention contemplates the provision of an electric current responsive actuator which has a thermally responsive force generator and an electromagnetically responsive force generator. The force generators are so coupled that they produce a resultant force on a force output member with enhanced thermal characteristics. In the preferred specific embodiment of the invention, a shape-memory alloy element serves as the thermally responsive force generator and a coil and magnetic armature serves as the magnetic force generator.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
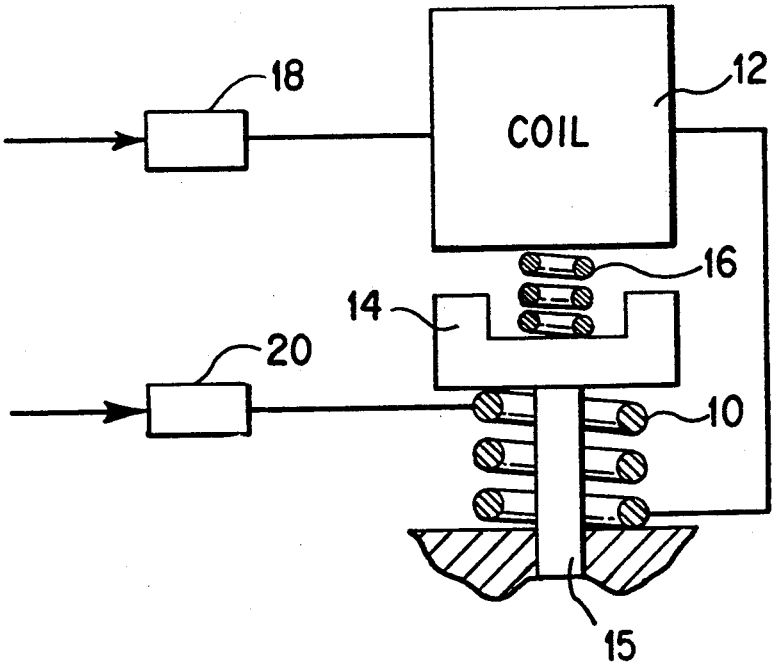
FIG. 1 is a schematic diagram of one embodiment of a current responsive actuator in accordance with the teachings of this invention.

Referring now to FIG. 1, it illustrates the salient elements of an actuator in accordance with the teachings of this invention; an actuator such as might be used in electrical distribution and control equipment, robotic devices, etc. The actuator has at least one thermal force generating element, here a shape-memory alloy spring 10, at least one magnetic force generating element, here a coil 12, and a coupling member, here an armature 14. An force output member 15 is secured to the armature. The thermal element also may be of a bi-metal or fusible alloy type. The magnetic element may be any of a number of suitable magnetic armature devices to the type used in conventional prior art magnetic actuating devices.

In the illustrative embodiment of FIG. 1, the shape-memory spring 10 urges the armature 14 toward the coil 12 against the force of a conventional bias spring 16. The coil 12 and the spring 10 are connected electrically in series between a pair of terminals 18 and 20. For certain applications the thermal and magnetic elements may be connected in parallel between the terminals or, as shown in FIG. 3, the thermal and magnetic elements may be coupled to different sources of electrical energy.

As will be appreciated by those skilled in the art a shape-memory alloy, such as spring 10, changes from an initial shape and stiffness to a different predetermined shape and stiffness as the temperature of the element reaches a specific value. Such alloys exhibit a mechanical strain recovery effect known as the shape-memory effect. This effect is associated with a reversible martensitic transition. The transition is known to be thermo-elastic in shape-memory alloy systems of the nickel-titanium; copper-zinc-aluminum; copper-aluminum-nickel type and non-thermo-elastic in stainless steel based shape-memory alloys. The crystal structure transformation occurs through a very narrow temperature band. The width and threshold temperature of such band may be precisely adjusted during manufacturing; that is the transformation threshold temperature and, the change in shape and stiffness can be accurately tailored to achieve a desired force verses temperature characteristic.

Figure 2:
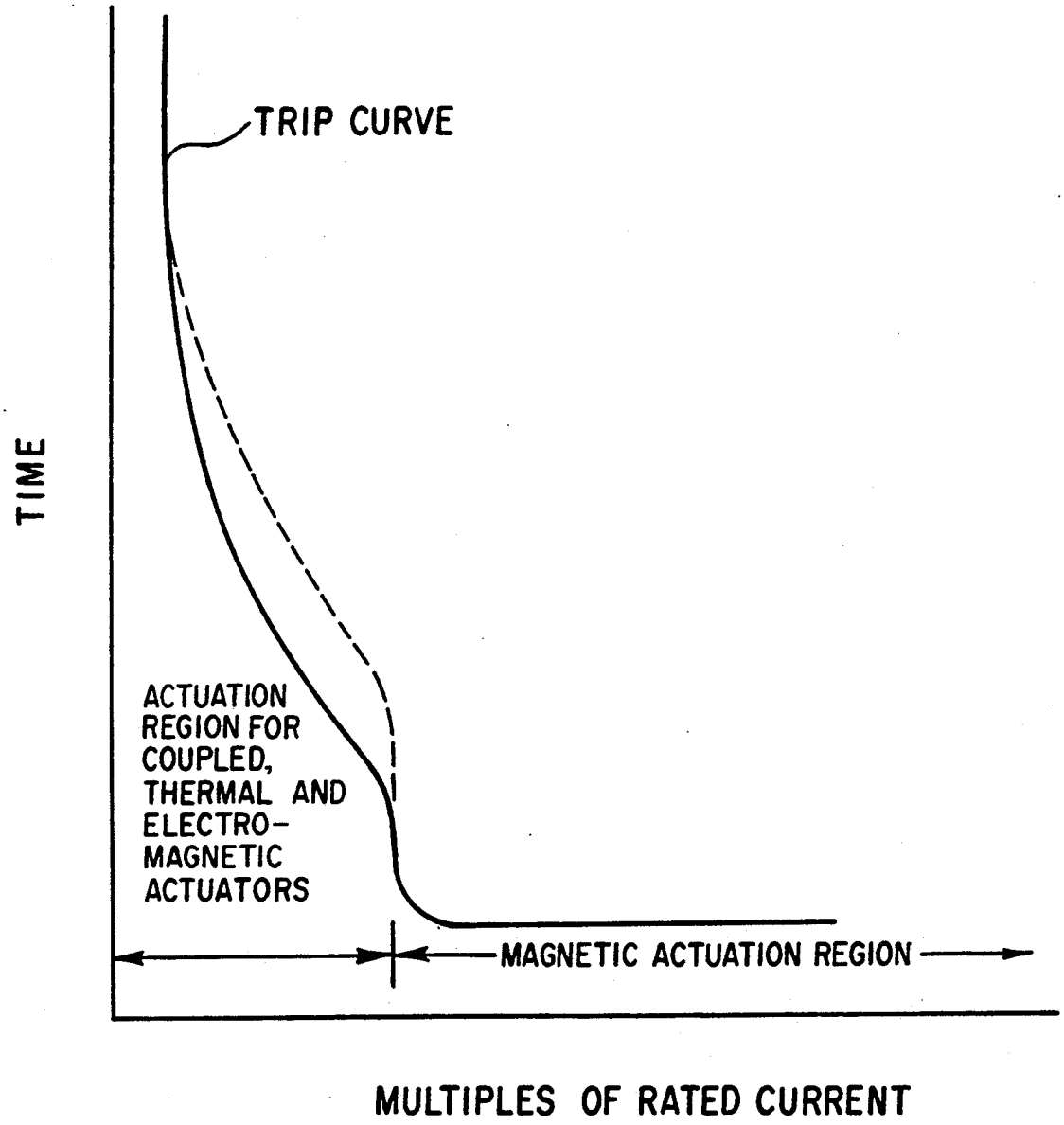
FIG. 2 is a graph showing a characteristic trip curve of thermal and electromagnetic actuators coupled in accordance with this invention and comparing it with prior art actuators.

Referring now to FIG. 2 as well as FIG. 1, as long as the current is below rated current, the temperature of the thermal element (e.g., spring 10) remains below its transition temperature. At rated current and below, the force exerted by the coil 12 on the armature 14 is negligible. A current above rated current heats the spring 10 to its transition temperature causing it to extend. The time required to heat the element to a point where it would generate a tripping force is a function of the magnitude of the overcurrent. A characteristic trip curve for an actuator with thermal and electromagnetic elements acting substantially independently is shown dotted in FIG. 2. In accordance with this invention the magnetic actuating element and thermal actuating element forces are coupled to act in the thermal actuation region as illustrated by the solid line. Here the combined force exerted by the shape-memory spring 10 and the force exerted by coil 12 acting on the armature when combined exceeds the bias force of the spring 16 at a time prior to the time sufficient heat would be generated to actuate the thermal element and at an overcurrent below that required to actuate the electromagnetic element.

Figure 3:
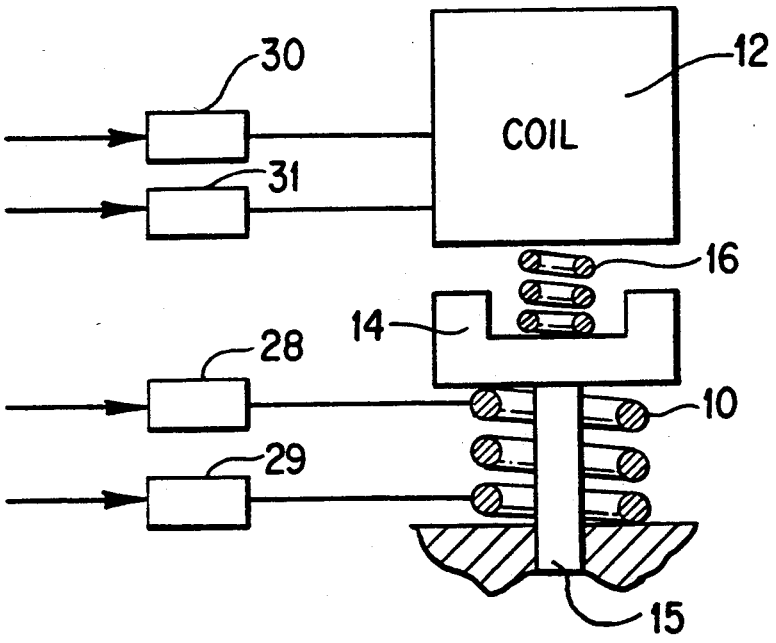
FIG. 3 is a schematic block diagram similar to FIG. 1 illustrating an alternative embodiment of the invention.

Referring now to FIG. 3, it shows a current responsive thermal and electromagnetic actuating members coupled together similar to that shown and explained in connection with FIGS. 1 and 2. Here, the coil 12 is connected to one pair of terminals 30 and 31 and the shape-memory element spring 10 is connected to another pair of terminals 28 and 29. This embodiment of the invention may serve as a motor protection device, for example.

Figure 4:
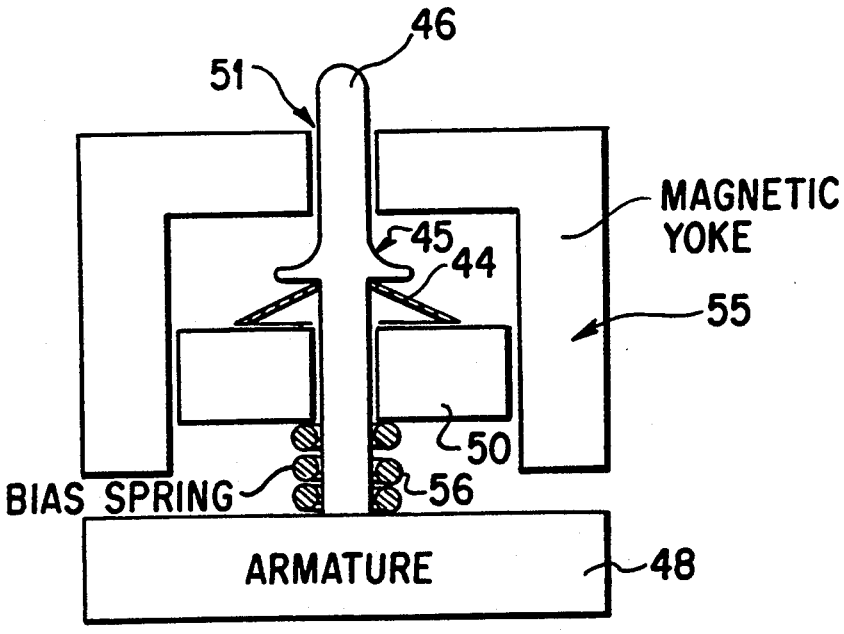
FIG. 4 is a schematic view of another alternative embodiment of the invention.

Referring now to FIG. 4, it shows a very compact embodiment of the invention. Here a shape-memory alloy belleville washer 44 serves as a thermal actuating element. The washer 44 is in close proximity to a bus bar 50 and heat is transferred from the bus bar to the washer by thermal radiation, conduction and convection. A coupling member 46 attached to an armature 48 passes through an opening 51 in the bus bar and a magnetic yoke 55 partially surrounds this region of the bar 50. The yoke couples the magnetic field of the bus bar to the armature. The belleville washer 44 engages a shoulder 45 on the coupling member 46 as shown. If the temperature of the washer is below its transition temperature, the sum of the aiding forces exerted by washer 44 and coil 50 are insufficient to overcome the force of a bias spring 56. When washer 44 reaches its transition temperature, it starts to contract urging the shoulder 45 away from the bus bar and the armature toward the yoke reducing the air gap between yoke and armature and increases the applied force. The combined operation is as illustrated in FIG. 2.

Figure 5:
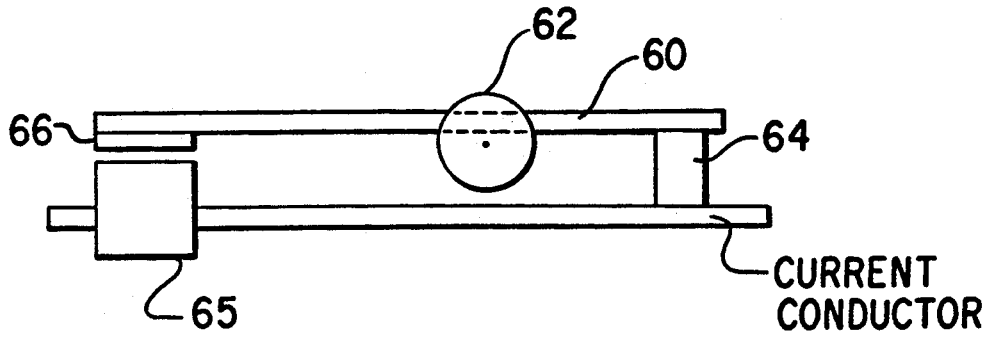
FIG. 5 is a schematic view of yet another embodiment of the invention.

Referring now to FIG. 5, it shows an embodiment of the invention in which the coupling member provides a mechanical advantage in the coupling operation and operates a trip bar for a three-pole circuit interrupter. Here the coupling member is a beam 60 mounted on a rotatable trip bar 62 for a three-pole circuit breaker. A thermal element 64, such as a shape-memory element spring acts to urge the beam 60 to rotate in a counter clockwise direction when it is heated to its transition temperature by an over current. A magnetic field produced by the current in a coil 65 attracts an armature 66 secured to the other end of the beam 60. Rotation of the trip bar 62 actuates the circuit breaker.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. An electric current responsive actuator comprising in combination:

a thermally responsive trip force generating element, disposed in close proximity to a current conductor and is thermally coupled thereto;

said thermally responsive trip force generating element designed to respond to a range of overcurrents as a function of the product of the magnitude of the overcurrent within the range and the duration of the overcurrent;

an electromagnetically responsive trip force generating element designed to respond to an overcurrent in said range, wherein said electromagnetically responsive trip force generating element includes a yoke and an armature surrounding said current conductor;

means to mechanically couple said thermally responsive and said electromagnetically responsive trip force generating elements to a force output member for producing a resultant actuation force; and said resultant force reaching a trip force in response to an overcurrent within said range in an interval in which the duration of said overcurrent is less than the duration required for said thermally responsive trip force generating element to reach said trip force in response to said overcurrent.

2. An electric current responsive actuator as in claim 1 wherein said yoke and said armature surround said thermally responsive element.

3. An electric current responsive actuator as in claim 1 wherein said conductor is a bus bar, and said actuator includes a rod passing through an opening in said bus bar.

4. An electric current responsive actuator as in claim 1 wherein said thermally responsive trip force generating element is a shape-memory alloy.

5. An electric current responsive actuator as in claim 4 wherein said thermally responsive trip force generating element is a shape-memory alloy.

6. An electric current responsive actuator as in claim 3 wherein said thermally responsive trip force generating element is a shape-memory alloy.

* * * * *